United States Patent [19]

Betts

[11] 4,378,682

[45] Apr. 5, 1983

[54] PRESSER FOOT FOR A KNITTING MACHINE

[75] Inventor: Max W. Betts, Coventry, England

[73] Assignee: Courtaulds Limited, London, England

[21] Appl. No.: 188,828

[22] Filed: Sep. 19, 1980

[30] Foreign Application Priority Data

Oct. 3, 1979 [GB] United Kingdom ..... 7934342

[51] Int. Cl.[3] ..... D04B 7/04

[52] U.S. Cl. ..... 66/64

[58] Field of Search ..... 66/60 R, 60 H, 64

[56] References Cited

U.S. PATENT DOCUMENTS

| | | | |
|---|---|---|---|
| 3,049,900 | 8/1962 | Bram | 66/60 |
| 3,153,922 | 10/1964 | Bram | 66/64 |
| 3,613,401 | 10/1971 | Jeffcoat et al. | 66/60 |
| 3,685,317 | 8/1972 | Giacuetti | 66/64 |
| 3,839,884 | 10/1974 | Flavell et al. | 66/64 |
| 3,842,623 | 10/1974 | Flavell et al. | 66/64 |
| 3,926,016 | 12/1975 | Flavell et al. | 66/157 |
| 3,952,553 | 4/1976 | Kohler | 66/64 |
| 3,973,416 | 8/1976 | Kohler | 66/64 |
| 4,027,504 | 6/1977 | Dietschy et al. | 66/64 |
| 4,081,973 | 4/1978 | Theys et al. | 66/64 |
| 4,083,203 | 4/1978 | Theys | 66/64 |

FOREIGN PATENT DOCUMENTS

| | | |
|---|---|---|
| 861059 | 3/1978 | Belgium . |
| 1133662 | 4/1957 | France . |
| 48-69956 | 9/1973 | Japan . |
| 382361 | 11/1964 | Switzerland . |
| 1288043 | 9/1972 | United Kingdom . |
| 1418314 | 12/1975 | United Kingdom . |
| 1458983 | 12/1976 | United Kingdom . |
| 1588970 | 5/1981 | United Kingdom . |
| 2068022 | 8/1981 | United Kingdom . |

*Primary Examiner*—Ronald Feldbaum

[57] ABSTRACT

A presser foot for a knitting machine with independently operable needles has a cross-section which is triangular or approximately triangular.

The presser foot may comprise two elements of strip-like form, for example of metallic sheet material, extending side-by-side in the longitudinal direction of the presser foot. These two elements are arranged so that longitudinally extending edges thereof which are intended to press on knitted loops and to be the lower longitudinally extending edges of the elements, in use, are more widely separated than the longitudinally extending edges of the elements located above them and intended to be the higher longitudinally extending edges, in use.

9 Claims, 9 Drawing Figures

Figure 1:
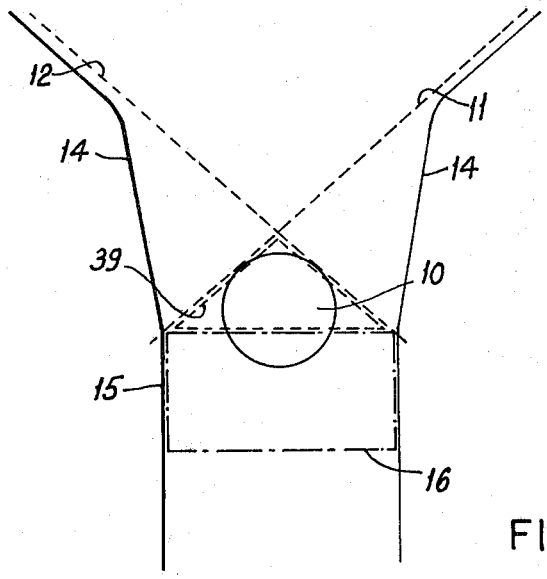

FIG. 4
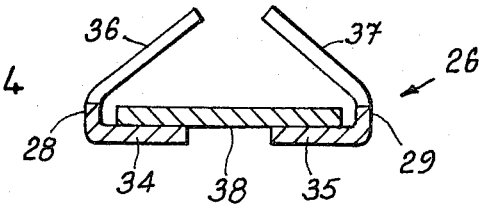
FIG. 3
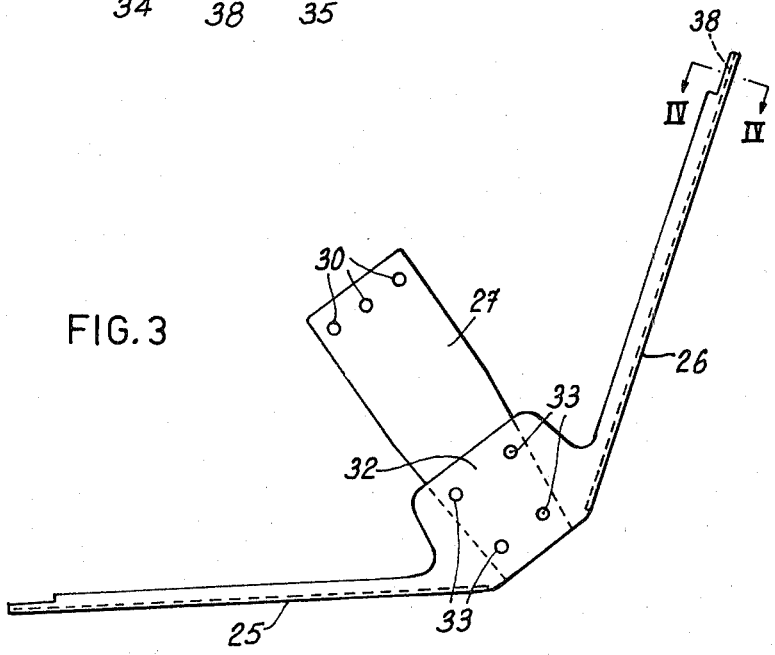
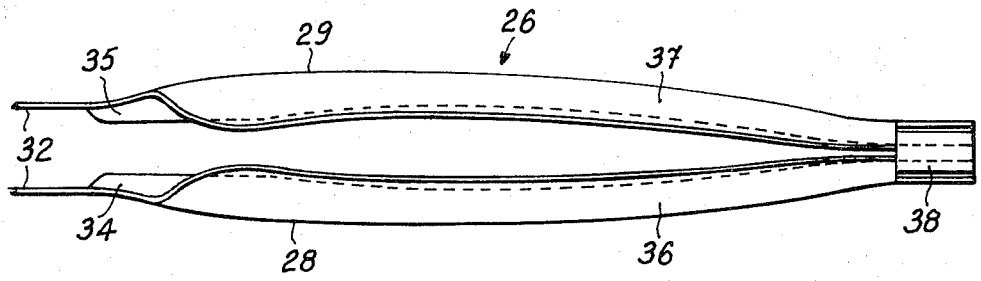
FIG. 5

PRESSER FOOT FOR A KNITTING MACHINE

This invention relates to a presser foot device for a flat V-bed knitting machine.

A flat V-bed knitting machine has two opposed needle beds arranged in an inverted V-formation and each containing an array of independently operable needles.

In the conventional V-flat machine in commercial use at present, the knitted fabric is pulled down away from the needles by means of nip rollers between which the fabric passes and this "roller take-down" as it is called, exerts on the knitted fabric, and thus on the loops held on the needles, the tension required to enable the knitting action of the needles to be carried out satisfactorily.

Recently, there have been introduced, for example by Messrs. Edouard Dubied & Cie. S. A. of Switzerland, flat V-bed knitting machines which can be operated without roller take-down. One such machine is the Dubied JDR-PM. Flat machines of this kind are fitted with a presser foot which is an element extending, in its operational position, longitudinally of and between the needle beds, approximately at the level of the knocking-over bits, in the region of the active needles.

In the JDR-PM machine, four presser feet are carried on the cam carriage of the knitting machine. The presser feet are arranged in pairs, each pair being associated with one of the cam systems of this double-system machine, and one presser foot of each pair is arranged to be in an operational position in relation to the needles of the machine, during movement of the cam carriage in one direction along the needle beds, the other presser foot of each pair being operational during the return movement of the carriage.

The function of the presser foot is to hold down the loops of the knitted fabric when the needles rise to take more yarn, and thereby to allow the knitting action to proceed without any need to exert tension on the fabric from below.

One form of presser foot device is disclosed in British Pat. No. 1,288,043. In that device, a supporting member extends downwardly from a presser foot carrier, two presser feet are mounted on the lower end of the supporting member and project away from each other in substantially opposite directions, and the supporting member is movably mounted on the carrier so as to be movable to bring one of the two presser feet into an operative position, for movement of the carrier in one direction along the needle beds and to bring the other presser foot into an operative position for movement of the carrier in the opposite direction along the needle beds. The presser foot carrier is arranged to carry the supporting member and the presser feet along the needle beds in synchronism with the activation of the needles and the presser feet are so located that the operative presser foot will hold down the loops on the needles as the needles rise.

The presser feet described in British Pat. No. 1,288,043 have cross-sections which are either circular or rectangular in shape. It has now been found that there are disadvantages in constructing presser feet with such cross-sectional shapes and the present invention relates to a presser foot having a cross-sectional shape giving it advantages over the previously known presser feet at least in some situations.

According to one aspect of the present invention, a presser foot for a knitting machine with independently operable needles has a cross-section which is triangular or approximately triangular in shape.

The presser foot may comprise two elements of strip-like form extending side-by-side in the longitudinal direction of the presser foot and arranged so that longitudinally extending edges of said elements intended to press on knitted loops and to be the lower longitudinally extending edges of said elements, in use, are more widely separated than the longitudinally extending edges of said elements located above them and intended to be the higher longitudinally extending edges, in use.

The said two strip-like elements may be arranged in a configuration such that each element is oriented or approximately oriented in a plane constituting one of two sides of a triangular prism, whereby, in cross-section the elements lie or approximately lie along two sides of a triangle providing a cross-sectional shape which is approximately triangular overall.

The terms "higher" and "lower" are used in this specification to indicate a disposition in relation to the needle beds of a knitting machine using the convention that the needles mounted in the beds move "up" to take yarn and then descend to form a knitted stitch. These terms do not necessarily entail any particular orientation with respect to a vertical direction in relation to the earth'centre.

Each of said strip-like elements may be formed from a piece of metallic sheet bent so that a strip of the sheet constitutes part of the base of the presser foot and a further strip of the sheet constitutes a side of the presser foot, the said side lying at an acute angle to the said base part so as to extend inwardly of and above the base part. The said elements may be spaced from one another and secured to a common support at their leading ends, that is the ends which meet the rising needles first when the foot is mounted in an operating knitting machine. The trailing ends of the elements may be secured together, for example by means of a metallic plate located between the elements on the base parts thereof at their trailing ends.

Advantageously, the elements are made of resilient material and are spaced apart so that they can be resiliently displaced towards one another. The elements may be bent so that they curve away from one another in the rearward direction from their leading ends and then approach one another again towards their trailing ends. The elements may also be shaped, for example by bending down a portion of the base part of each element so that, proceeding rearwardly from the leading end, the base of the presser foot presents a profile which first extends horizontally, then curves gradually down, then rises more steeply than the downward curve before merging into a horizontal portion at the trailing end of the presser foot.

Figure 2:
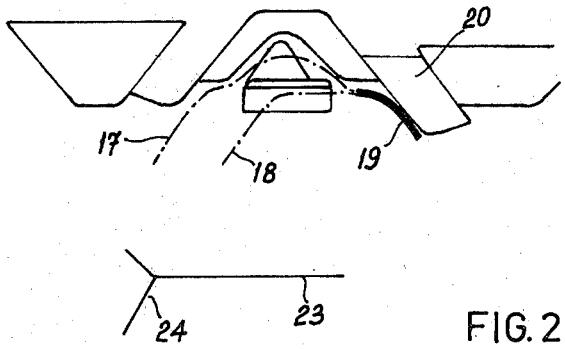
Figure 6:
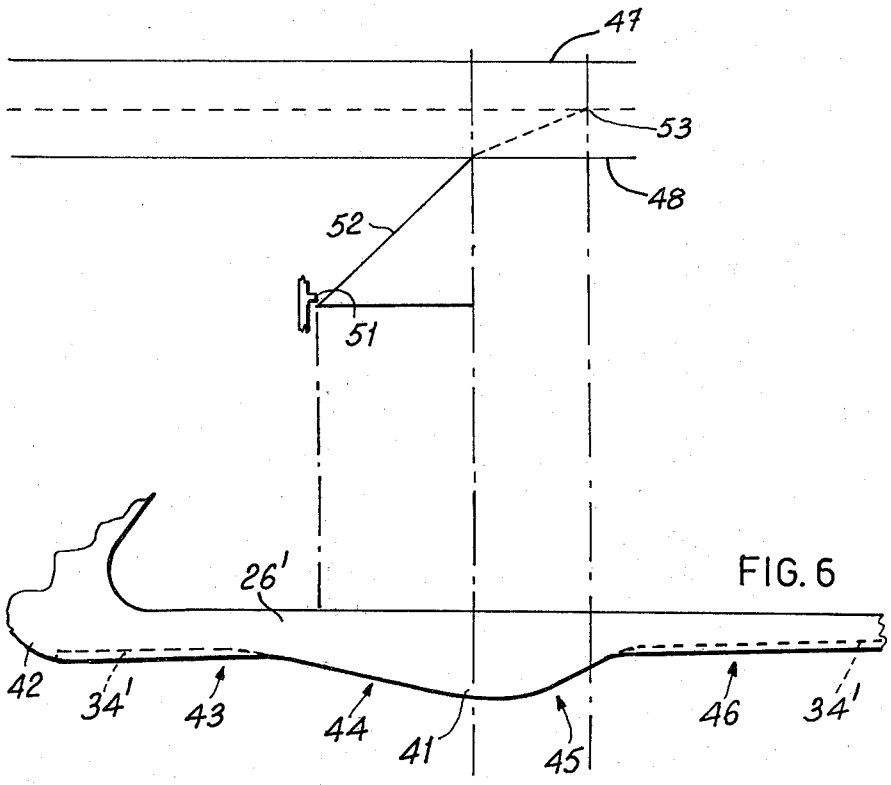
Figure 7:
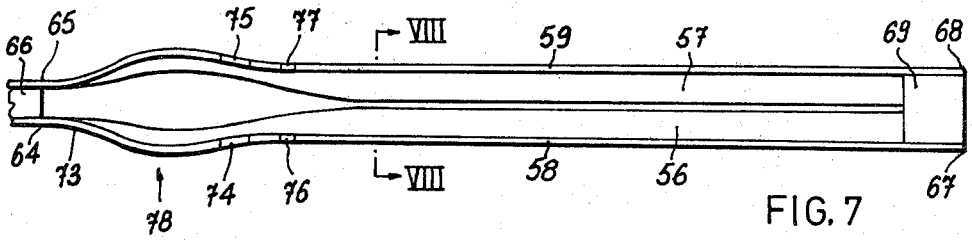
Figure 8:
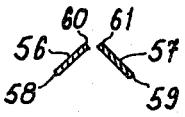
Figure 9:
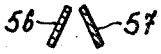

The invention will be further described, by way of example, with reference to the accompanying drawings, in which:

FIG. 1 is a diagram illustrating the location of conventional presser feet in a flat V-bed knitting machine, FIG. 2 is a diagram illustrating a cam system of a flat V-bed knitting machine and the location of a presser foot in relation to it, FIG. 3 is a side view of two presser feet according to the invention, FIG. 4 is a section on the line IV—IV of FIG. 3, FIG. 5 is a plan of part of a presser foot according to the invention, FIG. 6 is a diagram showing a modified presser foot according to the invention and illustrating its location in relation to an associated raising cam, FIG. 7 is a view from below of a further presser foot according to the invention, FIG. 8 is a section on the line VIII—VIII of FIG. 7, and FIG. 9 is a section on the same line as FIG. 8 when the presser foot is in use.

Conventionally, presser feet for knitting machines have been either circular or rectangular in cross-section. Feet of circular cross-section have typically been used to control rib knitting in V-flat knitting machines. Yarn loops extend, when knitting a rib structure, between the two needle beds of such a machine and a readily yieldable presser foot having a circular cross-section allowing it to rise high beneath the tent of the needles has been thought essential for successful knitting of such a structure. A typical location of such a presser foot is indicated by the full line 10 in FIG. 1 in which the broken lines 11 and 12 show the under-surfaces of the needles as they rise between the knocking-over bits 14 of the two needle beds 15 and form the needle tent. With the presser foot in the position shown, which is the position occupied by at least the parts of such a presser foot to the rear of the leading end, and which it can occupy because of the resilience of the material of the presser foot which allows the foot to be raised by the knitted loops, the loops have room to extend between the needles of the opposite needle beds without being subject to strain. Excessive strain on the loops can cause yarn to break, particularly when knitting rib structures with short stitch lengths.

On the other hand, a presser foot like the foot 10, located as shown, cannot exercise effective control over stitch structures knitted on the needles of one bed of needles only, the loops of which are located close to the associated needle bed and do not extend between the beds. To control the formation of loops in such stitch structures, conventionally, a presser foot having a cross-section such as that indicated by the chain-dotted line 16 in FIG. 1 has been used. This presser foot, because of its rectangular cross-section, extends close to the needle beds and can control loops located close to a needle bed. However, loops of yarn engaged on needles of both beds must follow a long path beneath such a foot between the needles of opposite beds and this can cause difficulties if knitting of rib structures is attempted with it.

A further problem which can occur when using the conventional presser feet illustrated in FIG. 1 can be understood from FIG. 2. Line 17 in FIG. 2 shows the track followed, through a needle cam system of a V-flat knitting machine, by the butts of needles raised to knit and line 18 shows the track followed by the butts of needles raised to carry out a tuck operation or raised to receive transferred loops. The needles are of course not always controlled by the needle cams, cams acting on jacks below the needles determining the greater part of the needle paths shown in FIG. 2 and only the thickened part 19 of the two tracks being determined by the knitting cam 20.

Also shown diagrammatically in FIG. 2 is the location, in relation to the knitting cams, of a presser foot 23. It can be seen that if a fabric is knitted containing in one course normal knitted stitches formed by needles following track 17, and tuck switches formed by needles following track 18, or if in the same course as knitted stitches are formed, needles are raised to receive transferred loops, then a presser foot 23 raised by the action of its leading end 24 in exerting control on loops carried by needles raised to knit will not be at a low enough level to exert an effective controlling action on loops carried on needles raised to tuck or receive loops.

The presser foot now to be described is effective in overcoming these problems.

FIG. 3 shows two presser feet 25 and 26 according to the invention secured to a common supporting blade 27 by which they can be mounted in a flat V-bed knitting machine, the blade 27 being formed with apertures 30 to receive studs for securing the presser foot unit in the knitting machine. In the machine, the presser foot unit may be carried, for example, by a supporting mechanism as described in British Pat. No. 1,288,043 or in British Pat. No. 1,458,983.

Each presser foot has a cross-section of approximately triangular shape, as shown in FIG. 4, and is composed of two elements 28 and 29 which extend side-by-side over the major part of the length of the presser foot and can be seen in plan in FIG. 5. Each element 28 (or 29) is part of a piece of metallic sheet formed into a central plate 32 and two outwardly extending arms which constitute side elements 28 or 29 of the two presser feet of the presser foot unit shown in FIG. 3. Each pair of elements 28 or 29 of the pair of presser feet are secured to the blade 27 by means of rivets 33 extending through their common central plate 32.

Each element 28 or 29 comprises a metallic strip 34 or 35 constituting part of the base of the presser foot and a further strip 36 or 37 lying at an acute angle to the base strip 34 or 35 so as to extend inwardly of and above the corresponding base strip. The elements 28 and 29 are spaced from one another and are secured at their leading ends to a common support, constituted by the blade 27, through the agency of their respective associated central plates 32, as already described.

The trailing ends of the elements 28 and 29 of each presser foot are secured together by means of a short metallic plate 38 lying on the end portions of the strips 34 and 35 and secured thereto by soldering or welding.

The strips 36 and 37 are cut away at the trailing ends of the elements 28 and 29 in the region of the plate 38.

The metallic sheets from which each pair of elements 28 and 29 are made are of resilient material and the elements are bent, as shown in FIG. 5, so that they curve away from one another in the rearward direction from their leading ends and then approach one another again towards their trailing ends. The elements can thus be displaced towards one another but because of their resilient nature will tend to return to the configuration shown in FIG. 5. The presser foot can thus accommodate itself to gaps between needle beds of differing width and, within given variations in bed gap, will still act adjacent the needle beds to control loops of knitting held on the needles of one bed only and located adjacent that bed. Because of its triangular cross-sectional shape, the presser foot can ride up into the tent of the needles to the position of the profile 39 shown in broken lines in FIG. 1 and will not therefore depress loops of knitting extending between the two needle beds to the same extent as a conventional presser foot in the position of the foot 10. The present presser foot is thus less likely to cause breakage of yarn when executing rib knitting.

Part of a modified presser foot is shown in FIG. 6 where one element 26' of the foot is visible. A portion 41 of the base part 34' of this element (and of the base part of the adjacent longitudinal element of the presser foot, not shown) is bent down so that, proceeding rearwardly from the leading end 42 of this presser foot, the base of the presser foot presents a side-profile which first extends horizontally in the portion 43 of the foot, then curves gradually down over the portion 44, rises over the portion 45, more steeply than the downward curve, and merges into a horizontal portion 46 extending to the trailing end of the presser foot. The presence of the inwardly extending sections of the base part 34' at the leading and trailing ends of the presser foot is shown in FIG. 6 by broken lines.

The location of the presser foot of FIG. 6 in the longitudinal direction of the needle beds in the knitting machine, in relation to the associated needle operating cams, is illustrated in FIG. 6 where the needle beds 47 and 48 are shown diagrammatically. Each operative presser foot is associated with a corresponding cam system and rise of a needle to knit under the influence of that cam system commences with the impingement of a butt 51 associated with the needle on the upwardly sloping surface 52 of a raising cam shown at a typical angle of 50°. The raising cam surface 52 in FIG. 6 is shown only as high as the point at which a needle raised by the cam is brought to the "Fleur le Jack" position in which the inner surface of the needle hook (not shown) is flush with the surface of the knocking-over bits of the machine. In this position of the needle, the stitch length is zero. This position corresponds approximately with the lowest point of the downwardly extending portion 41 of the presser foot 26', and rearwardly of this portion the presser foot profile descends no further and in fact begins to rise either at once, or, as shown, at least before the region of needle cross-over 53. Approximately at the position of needle-cross-over 53 or a little rearwardly of that position, the downwardly extending portion 41 merges into the main body of the presser foot and the base 34' of the presser foot then extends rearwardly and horizontally at the same height in relation to the needle beds as the base of the leading portion of the presser foot, that is the height of the lower edge of the profile 39 in FIG. 1. However, the trailing portion of the base 34' of the presser foot 26' need not extend exactly horizontally and need not be located exactly at the height shown in FIG. 6.

FIGS. 7, 8 and 9 show a further presser foot according to the invention. The presser foot comprises two resilient strip-like elements 56 and 57 extending side-by-side in the longitudinal direction of the presser foot. In this form of presser foot, the general configuration of the elements 56 and 57 is such that each is approximately oriented in a different plane constituting one of two sides of a triangular prism.

In cross-section the elements 56 and 57 lie along sides of a triangle and provide a presser foot with a generally triangular configuration (see FIG. 8). No part of either element 56 or 57 lies in the base plane of the presser foot because it has been found that this is not necessary for efficient operation of the foot. Indeed, it can be an advantage to have the lower longitudinally extending edges 58 and 59 of the elements 56 and 57 press on the knitted loops in the proximity of the needle beds of the knitting machine. As can be seen in FIG. 8, the lower longitudinally extending edges 58 and 59 of the elements 56 and 57 are more widely separated than the higher longitudinally extending edges 60 and 61.

Each of the elements 56 and 57 is integral with a plate 64 or 65 similar to the plates 32 of FIG. 3 and a further similar presser foot element is also integral with and projects in the opposite direction from the plate in the same manner as do the elements 25 and 26 in FIG. 3. The presser feet elements are secured to a supporting blade 66 similar to the blade 27 in FIG. 3.

The trailing ends 67 and 68 of the elements 56 and 57 are secured to one another by a block of solder 69 of approximately triangular configuration.

Each element 56 or 57 is shaped in profile in a manner similar to the element 26' shown in FIG. 6. Thus, the element is shaped so that proceeding rearwardly from the leading end 73 the profile of the lower edge 58 or 59 first extends horizontally, then curves gradually down along sloping portion 74 or 75, then rises more steeply than the downward curve, along sloping portion 76 or 77 and merges into a horizontal portion of the edge extending to the trailing end 67 or 68 of the element.

Seen from below in FIG. 7, the presser foot has a configuration which starts at the leading end with parallel plates 64 and 65 merging into the strip-like elements 56 and 57, also initially in parallel planes but soon diverging from one another and taking on an inclination which increases, reaching its maximum in the region of the upward curves 76 and 77 and thereafter retaining this maximum inclination, at least in the undeformed condition of the presser foot, to the trailing ends 67 and 68 of the elements 56 and 57. The divergence of the two elements 56 and 57 reaches its maximum in advance of the downward curves 74 and 75, that is in the region 78 in advance of the start of the needle rise when the presser foot is in operational position in a knitting machine, as illustrated for the presser foot element 26' in FIG. 6.

The configuration of presser foot just described enables the leading divergent portions of the elements 56 and 57 to act immediately adjacent the knocking-over bits mounted in the needle beds since it is intended that the elements in the region 78 should be splayed apart sufficiently to bring each element into contact with the adjacent knocking-over bits. The remaining portion of each element 56 or 57 will press on the knitted loops slightly inwardly of the knocking-over bits. In fact, the configuration of the elements 56 and 57 is such that when pressing on rib knitting, having loops extending between the needle beds, the upward forces exerted by the knitted loops on the elements has the effect of deforming them to move their lower edges a greater distance towards one another than their upper edges producing a cross-section which is still triangular as shown in FIG. 9 but which is effectively narrower than the undeformed configuration of the presser foot with the sides of the triangle in which the elements 56 and 57 lie disposed at a more acute angle to one another than in the undeformed configuration. Thus, the foot allows the knitted loops to take a considerably shorter path between the needle beds than does the presser foot 16 in FIG. 1 or the undeformed configuration of presser foot cross-section shown in FIG. 8 and thus places less strain on the knitting yarn.

What is claimed is:

1. A presser foot for a knitting machine having independently operable needles disposed in at least two needle beds, said presser foot being adapted for movement across the needle beds in synchronism with needle operation and comprising an elongate presser member comprising:

(a) two elongate side-by-side presser elements providing side parts of said presser member, (b) said side parts sloping upwardly and inwardly with respect to one another in a roof-like configuration.

2. A presser foot for a knitting machine having independently operable needles disposed in at least two needle beds, said presser foot being adapted for movement across the needle beds in synchronism with needle operation and comprising an elongate presser member comprising:

(a) two resilient elongate side-by-side presser elements extending in the longitudinal direction of said presser member and providing side parts of said presser member, (b) said side parts sloping upwardly and inwardly with respect to one another and being resiliently displaceable towards one another.

3. A presser foot as claimed in claim 2 wherein said presser elements are shaped so that they curve away from one another in the rearward direction from their leading ends and then approach one another again towards their trailing ends.

4. A presser foot as claimed in claim 3 wherein said presser elements are connection together in a region of their leading ends and in the region of their trailing ends.

5. A presser foot as claimed in claim 3 including a laminar support at its leading end, each of said presser elements being secured to a separate surface of said laminar support at its leading end and the trailing ends of the elements being rigidly connected to one another.

6. A presser foot as claimed in claim 5 wherein each presser element of the presser foot is shaped so that proceeding rearwardly from the leading end, the profile of the underside of the presser foot first extends horizontally, then curves gradually down, then rises more steeply than the downward curve and merges into a horizontal portion extending to the trailing end of the presser foot.

7. A presser foot as claimed in claim 5 wherein at their leading ends the said presser elements are disposed in parallel planes, and proceeding from the leading ends towards their trailing ends the presser elements first diverge and their lower edges become more widely separated than their upper edges, the presser elements then converge and finally become approximately parallel to one another, still with their lower edges separated more widely then their upper edges in the undeformed condition of the presser foot, the elements being thus adapted, when displaced towards one another, to deform so that they lie at a more acute angle with respect to one another with the planes of the presser elements more nearly parallel.

8. A presser foot as claimed in claim 2 wherein said presser elements have upper and lower edges and proceeding from the leading ends of said presser elements towards their trailing ends, the elements first diverge and their lower edges become more widely separated than their upper edges, the elements then converge and finally become approximately parallel still with their lower edges spaced more widely than their upper edges, at least in the undeformed condition of the presser foot, the elements being thus adapted, when displaced towards one another, to deform so that they lie at a more acute angle with respect to one another with said elements lying in planes more nearly parallel to one another.

9. A presser foot as claimed in claim 8 wherein each of said elements is shaped so that proceeding rearwardly from the leading end, the profile of the lower edge of the presser element first extends horizontally, then curves gradually down, then rises more steeply than the downward curve and finally merges into a horizontal portion extending to the trailing end of the presser element where the presser elements are rigidly secured in relation to one another.

* * * * *